US008622242B2

(12) United States Patent
Pelfrey

(10) Patent No.: US 8,622,242 B2
(45) Date of Patent: Jan. 7, 2014

(54) TAGGANT KEYING SYSTEM FOR DISPENSING SYSTEMS

(75) Inventor: Keith A. Pelfrey, Wadsworth, OH (US)

(73) Assignee: Gojo Industries, Inc., Akron, OH (US)

( * ) Notice: Subject to any disclaimer, the term of this patent is extended or adjusted under 35 U.S.C. 154(b) by 148 days.

(21) Appl. No.: 13/083,946

(22) Filed: Apr. 11, 2011

(65) Prior Publication Data

US 2011/0253744 A1 Oct. 20, 2011

Related U.S. Application Data

(60) Provisional application No. 61/324,975, filed on Apr. 16, 2010.

(51) Int. Cl.
*B67D 1/00* (2006.01)

(52) U.S. Cl.
USPC ..... 222/23; 222/52; 222/63; 222/181.3; 222/325; 250/221; 250/458.1; 235/454; 382/141

(58) Field of Classification Search
USPC ..... 222/214, 189.1, 52, 325, 181.1, 23, 63, 222/181.3; 250/221, 458.1; 206/459.5, 206/459.1; 264/4.1; 235/454; 382/141
See application file for complete search history.

(56) References Cited

U.S. PATENT DOCUMENTS 4,527,051 A * 7/1985 Stenzel ..... 235/380
5,602,381 A * 2/1997 Hoshino et al. ..... 235/493
5,836,482 A * 11/1998 Ophardt et al. ..... 222/325
6,746,053 B1 * 6/2004 Afzali-Ardakani et al. .... 283/72
6,817,538 B2 * 11/2004 Afzali-Ardakani et al. .. 235/494
7,055,691 B2 6/2006 Safian
7,488,954 B2 * 2/2009 Ross et al. ..... 250/458.1
7,621,426 B2 11/2009 Reynolds
7,837,066 B2 * 11/2010 Reynolds et al. ..... 222/52
8,071,933 B2 * 12/2011 Ophardt et al. ..... 250/221
8,074,836 B2 * 12/2011 Reynolds et al. ..... 222/1
8,186,573 B2 * 5/2012 Callegari et al. ..... 235/375
8,212,949 B2 * 7/2012 Pelfrey et al. ..... 349/16
8,243,217 B2 * 8/2012 Pelfrey ..... 349/16
8,245,879 B2 * 8/2012 Wegelin ..... 222/52
2002/0094058 A1 7/2002 Kaiser et al.
2003/0134330 A1 * 7/2003 Ravkin et al. ..... 435/7.1
2003/0211035 A1 * 11/2003 Burns et al. ..... 424/1.11
2005/0112768 A1 5/2005 Evans et al.
2005/0127090 A1 6/2005 Sayers
2005/0276906 A1 * 12/2005 Metzger ..... 427/7
2008/0025594 A1 * 1/2008 Metzger ..... 382/141
2008/0139342 A1 * 6/2008 Hebert et al. ..... 473/377
2008/0283612 A1 11/2008 Fearn
2009/0008408 A1 1/2009 Ophardt
2009/0045360 A1 * 2/2009 Wosnick et al. ..... 250/586
2009/0127282 A1 * 5/2009 Reynolds et al. ..... 222/23
2009/0131203 A1 * 5/2009 Hebert et al. ..... 473/378
2009/0204256 A1 * 8/2009 Wegelin ..... 700/244

(Continued)

*Primary Examiner* — Kevin P Shaver
*Assistant Examiner* — Christopher Luzecky
(74) *Attorney, Agent, or Firm* — Renner Kenner Greive Bobak Taylor & Weber

(57) ABSTRACT

A dispensing system with an electronic keying mechanism, the dispenser including a housing and a refill unit. The refill unit includes a product reservoir, a pump mechanism and a collar adapted to secure the refill unit within the housing. An infrared sensor is provided in the housing and includes an infrared radiation source and a detector. A taggant is dispersed within at least a portion of the collar, the taggant being detectable by the detector when exposed to infrared radiation.

12 Claims, 8 Drawing Sheets

(56) References Cited

U.S. PATENT DOCUMENTS

| | | | | |
|---|---|---|---|---|
| 2009/0314800 | A1* | 12/2009 | Reynolds et al. | 222/23 |
| 2010/0149531 | A1* | 6/2010 | Tang | 356/317 |
| 2010/0237096 | A1* | 9/2010 | Wegelin | 222/52 |
| 2010/0252569 | A1* | 10/2010 | Pelfrey | 222/52 |
| 2010/0332022 | A1* | 12/2010 | Wegelin et al. | 700/231 |
| 2011/0050431 | A1* | 3/2011 | Hood et al. | 340/603 |
| 2011/0053283 | A1* | 3/2011 | Hood et al. | 436/104 |
| 2011/0108578 | A1* | 5/2011 | Wegelin et al. | 222/181.3 |
| 2011/0114669 | A1* | 5/2011 | Yang et al. | 222/52 |
| 2011/0127291 | A1* | 6/2011 | Tramontina et al. | 222/1 |
| 2011/0233426 | A1* | 9/2011 | Carroll et al. | 250/458.1 |
| 2011/0278322 | A1* | 11/2011 | Reynolds et al. | 222/1 |
| 2012/0031922 | A1* | 2/2012 | Johnson | 222/23 |
| 2012/0068056 | A1* | 3/2012 | Ophardt et al. | 250/221 |
| 2012/0211564 | A1* | 8/2012 | Callegari et al. | 235/454 |
| 2012/0216487 | A1* | 8/2012 | Henkel | 53/167 |
| 2012/0223130 | A1* | 9/2012 | Knopp et al. | 235/375 |
| 2012/0234858 | A1* | 9/2012 | Ophardt | 222/52 |

* cited by examiner

TAGGANT KEYING SYSTEM FOR DISPENSING SYSTEMS

This application claims priority from U.S. Provisional Application Ser. No. 61/324,975 filed on Apr. 16, 2010, which is incorporated herein by reference in its entirety.

FIELD OF THE INVENTION

The present invention is generally directed to dispensing systems. In particular, the present invention is directed to keyed dispensers that allow only designated refill units to be installed therein. More specifically, the present invention is directed to electronically keyed fluid dispensing systems including an infrared radiation readable taggant dispersed within at least a portion of the refill unit.

BACKGROUND OF THE INVENTION

It is well known to provide fluid dispensers for use in restaurants, factories, hospitals, bathrooms and the home. These dispensers may contain one of a number of products such as, for example, soap, anti-bacterial cleansers, disinfectants, lotions and the like. The dispensers may include some type of pump actuation mechanism where the user pushes or pulls a lever to dispense a quantity of fluid, as is known in the art. Alternatively, "hands-free" automatic dispensers may also be utilized where the user simply places one or both hands underneath a sensor and a quantity of fluid is dispensed. Similar types of dispensers may be used to dispense powder or aerosol materials.

Product dispensers are commonly configured to be mounted on to a wall or other vertical surface, with product being dispensed from an outlet near the bottom of the dispenser. It is also known that dispensers may be integrated into a countertop near a sink basin, with certain components of the dispensing system being located beneath the countertop, and other components, including an outlet, being located above the countertop. These types of dispensers are often referred to as counter-mount dispensing systems. Various other configurations of dispensers are also known, including table-top style dispensers that rest on a horizontal surface such as a counter or table top, or stand mounted dispensing systems that attach to a mounting pole.

Dispensers may directly hold a quantity of product, but such dispensers have been found to be both messy and difficult to service. These bulk fill systems may also pose contamination and health concerns. As a result, refill units or containers that hold a quantity of fluid and provide a pump and nozzle mechanism have become increasingly popular. The sanitary refill units or containers are advantageous in that they are easily installed and replaced and create virtually no mess.

For varying reasons, manufacturers of fluid materials commonly wish to control the type of refill put in a dispenser. It is often of concern that the correct refill unit (type of product, concentration, product form, etc.) is put in the correct dispenser housing. In many cases, installing the correct refill unit is crucial to the customer. For example, it is imperative to hospital personnel to have anti-bacterial soap dispensed in a pre-surgical cleaning area, rather than another fluid such as, for example, moisturizing lotion. Therefore, manufacturers often provide keyed nozzle and pump mechanisms for each type of fluid refill unit so that only the appropriate refill unit can be installed in corresponding fluid dispensers. Manufacturers and associated distributors also rely upon keying systems to ensure that the dispensers can only be refilled with their own products and not products that may be inferior or have poor quality.

Although mechanical keys are helpful in ensuring that the proper refill unit is installed into the proper dispenser and that high quality product remains in the dispensers, these keying systems also have a number of disadvantages. For example, mechanical keys are often easily removed or altered. Thus, inferior fluid may be installed into a particular dispenser and the manufacturer and distributor may lose the ability to control quality of the product in the dispenser. Mechanical keying also necessitates significant tooling costs underwritten by the manufacturer to design special nozzles and dispensers that are compatible with one another. In other words, each dispenser must be keyed for a particular product, a particular distributor and perhaps even a particular location. Accordingly, the inventory costs for maintaining refill units with a particular key is significant. In addition, the lead time for manufacturing such a refill unit may be quite lengthy. Moreover, the identification of a particular keying device in a dispenser may be lost or damaged so that it is difficult to determine which type of keying configuration is needed for the refill units.

One non-mechanical attempt at controlling the type of product associated with a dispenser is disclosed in U.S. Pat. No. 6,431,400B1. This patent discloses a refill unit that utilizes a wafer with an embedded magnet that must be properly oriented into a housing in order for the magnet to be detected and effectively close an on/off switch. If the magnet is not detected then the dispenser is disabled. Although effective in its stated purpose, the device disclosed in the patent suffers from the disadvantage that a specific orientation is required for installation of the refill unit. The patent also discloses the use of a spiral coil on a printed circuit wafer on the bag which is inductively coupled to a similar spiral coil on the housing's base supporting surface. A capacitor connected to the spiral coil on the bag establishes a resonant frequency for a conventional frequency-measuring circuit to provide identification. It is believed that this design is lacking because it provides no teaching for adaptability for use with multiple dispensers. It is also believed that the disclosed configuration is subject to a mis-alignment of the coils which may lead to mis-identification of the bag. In addition, the use of a single coil as the emitting and receiving coils may lead to mis-identification of the bag.

Another non-mechanical attempt at controlling the type of product associated with a dispenser is disclosed in U.S. Pat. No. 7,621,426. This patent discloses a dispensing system that utilizes a near field frequency response to determine whether a refill unit is compatible with a dispensing system. In particular, the refill unit is provided with a coil terminated by one of a number of capacitors. The refill unit is received in a housing that provides a pair of coils that are in a spatial relationship with the installed refill unit's coil. By energizing one of the housing's coils, the other coil detects a unique electronic signature generated by the refill unit's coil. If the signature is acceptable the dispensing system is allowed to dispense a quantity of material. This dispensing system, however, suffers from the disadvantage that it is not easily recycled. The metal coils prevent recycling of the component in which they are located, namely a collar of the refill unit. Given the increasing desire to provide eco-friendly products and reduce the consumption of natural resources, the copper coils provided in this dispensing system may present a disadvantage.

Thus, the need exists for a sustainable electronic keying system for a fluid dispenser and refill unit.

SUMMARY OF THE INVENTION

In light of the foregoing, it is a first aspect of the present invention to provide an electronically keyed dispensing system.

It is another aspect of the present invention to provide a dispensing system, as above, that is environmentally friendly and recyclable.

It is still another aspect of the present invention to provide a dispensing system, as above, that includes an infrared radiation (IR) sensor in the housing and an IR readable taggant dispersed within at least a portion of the refill unit.

It is yet another aspect of the present invention to provide a dispensing system, as above, that prevents actuating of the system unless a refill unit with a predetermined signature is installed.

In general, a product dispenser unit for receipt of a refill unit having a reservoir of a product according to the present invention includes a housing being configured to accept the refill unit; an actuator configured to actuate a pump to dispense at least a portion of the product in the refill unit; and an infrared sensor configured to detect infrared radiation emitted from said refill unit.

In accordance with at least one aspect of the present invention, a dispensing system includes a housing including an actuator and an infrared sensor, said infrared sensor including an infrared radiation source and a detector; and a refill unit including a product reservoir containing a product and a taggant dispersed within at least a portion of said refill unit, said taggant being detectable by the infrared sensor to identify an authorized refill unit.

In accordance with at least one aspect of the present invention, a method of preventing use of unauthorized refill units in a dispensing system includes providing a dispenser housing including an actuator and an infrared sensor having an infrared radiation source and a detector; and providing a refill unit having a reservoir of product and a taggant dispersed within at least a portion of said refill unit, wherein said taggant is detectable by said infrared radiation source, and wherein absence of said taggant prevents dispensing of said product.

BRIEF DESCRIPTION OF THE DRAWINGS

For a full understanding of the invention reference should be made to the following detailed description and the accompanying drawings, wherein.

DETAILED DESCRIPTION OF THE ILLUSTRATIVE EMBODIMENTS

Figure 1:
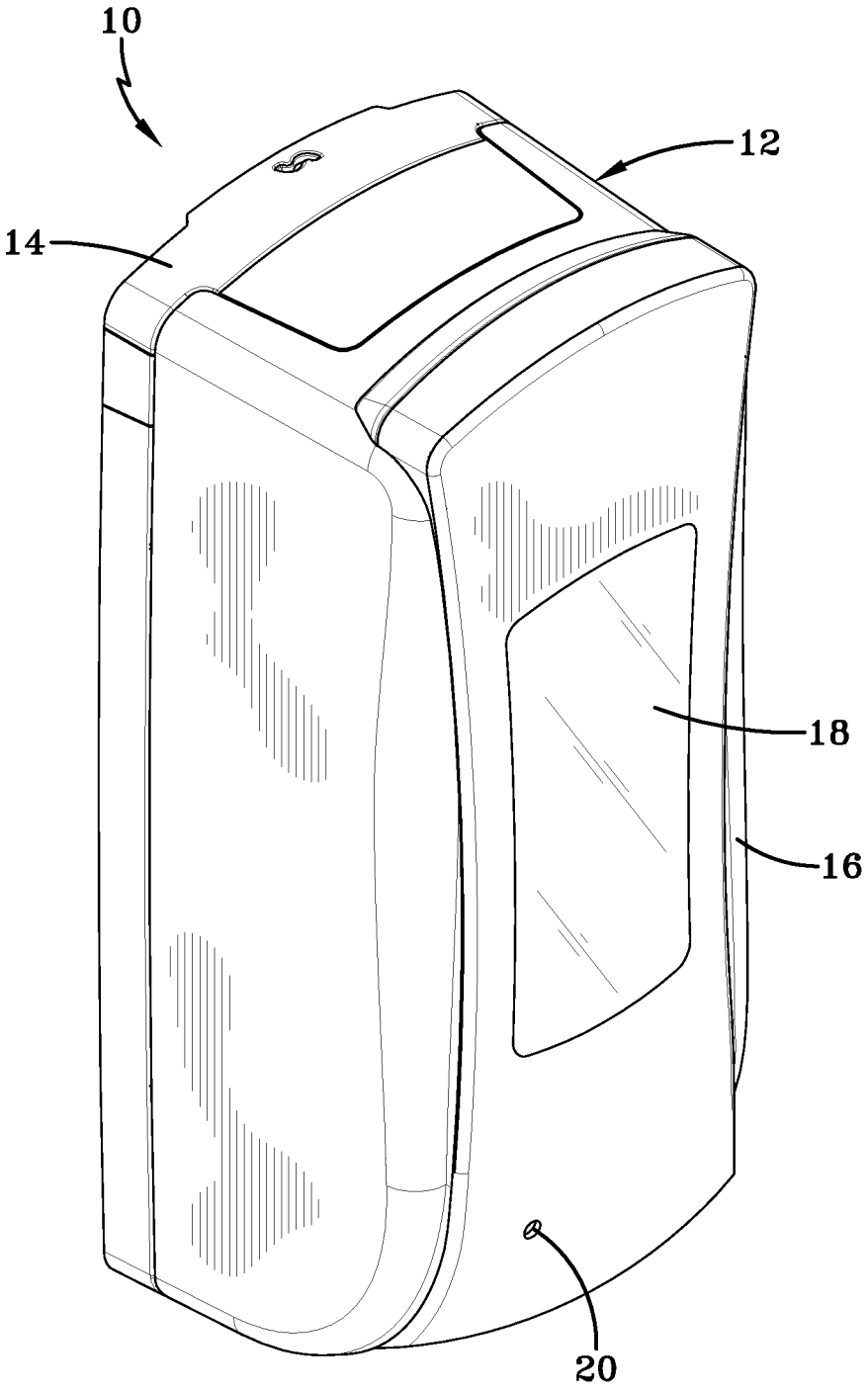
FIG. 1 is a front perspective view of a keyed fluid dispenser made in accordance with the concepts of the present invention.

It will be appreciated from reading the background of the invention that a primary concern in the field of fluid dispensing systems is the ability to prevent unauthorized refill units from being installed in a manufacturer's dispenser or in dispensers serviced by a distributor authorized by the manufacturer. The dispensing system disclosed herein fills this need by providing the refill unit with a unique identifier, and providing the dispenser housing with a sensor adapted to sense the presence of only that unique identifier.

A microprocessor based controller is associated with either the refill unit, or the dispenser housing. The controller may be used to control any number of operational mechanisms that permit use of the dispensing system. The dispenser disclosed herein may utilize operational mechanisms such as a push bar mechanism or a "hands-free" automatic sensor mechanism for dispensing a quantity of product. The push bar mechanism may be actuated by pushing a bar that actuates a pump mechanism carried by the refill unit to dispense a measured quantity of fluid. The "hands-free" device, an example of which is disclosed in U.S. Pat. No. 6,390,329, and which is incorporated herein by reference, utilizes a sensor that detects the presence of an individual's hand and then dispenses a measured quantity of fluid. The controller may also be operative with a mechanism that controls a pump associated with the refill unit, wherein incompatibility of the refill unit with the dispenser housing may preclude actuation of the pump.

In order to operate the hands-free dispenser and other dispensers it is known to provide a power source, such as low voltage batteries, within the fluid dispenser housing. The batteries contained within the fluid dispenser may be utilized to operate the controller and/or the communication device associated with the dispenser housing. In the alternative, power may be externally provided via an electronic key inserted into the dispenser.

As will be appreciated from the description to follow, the various features of the different embodiments of the invention may be utilized in any number of combinations and with one or multiple dispensers. Accordingly, while the following detailed description and figures set out preferred embodiments of the invention, the scope of the invention should not be unduly limited to the specific components or arrangements discussed herein. It is noted that the figures show an illustrative embodiment using a wall-mounted style soap dispenser, configured to mount on a vertical surface, the invention expressly includes and can be applied to dispensing systems of other configurations, including but not limited to countermount, table top, stand mounted and other fluid dispensing systems. It is also contemplated that invention may apply to any dispensing system wherein a refill unit is accepted into a dispensing unit and is not limited by the configuration of the dispensing unit or the product dispensed.

Referring now to FIGS. 1-4, a dispensing system is shown, generally indicated by the numeral 10. Dispensing system 10 includes a housing 12 which encloses and protects the internal components of dispensing system 10. Housing 12 includes a back plate 14 adapted to be secured to a vertical surface, and a cover 16 that is pivotable relative to back plate 14. Cover 16 allows access to the internal components of dispensing system 10 to facilitate replacement of a refill unit. A latching mechanism (not shown) secures cover 16 to back plate 14 during normal operation of dispensing system 10, and is releasable to allow cover 16 to pivot relative to back plate 14. The cover 16 may include an observation window 18 so that the interior of the dispenser 10 can be viewed, if desired. An LED indicator 20 may also be provided, wherein illumination of the indicator 20 shows that the dispenser is on and non-illumination of the LED indicates that the unit is inoperative.

A refill unit 22 (FIG. 4) is received in housing 12 and is adapted to be replaceable. Refill unit 22 includes a product reservoir 24 and a pump mechanism 26 that is in fluid communication with the product reservoir. Product reservoir 24 retains the material to be dispensed by the system. The material may be any fluid or other form of product known to those skilled in the art including, for example, liquid soap, hand sanitizer, gels, foams or lotions.

Pump mechanism 26 may be any pump known to those skilled in the art and capable of dispensing a metered amount of fluid from product reservoir 24. For example, pump mechanism 26 may be a plunger or piston pump, a diaphragm pump, a bellows pump, a peristaltic pump, or any other known positive displacement pump. Pump mechanism 26 is operatively engaged with the actuating mechanism of the dispenser when refill unit 22 is installed. Thus, activation of the actuating mechanism causes the pump to dispense a metered volume of fluid. Actuating mechanisms suitable for use with dispenser, and methods of operatively connecting the actuating mechanism to a pump, are well known in the art.

Figure 2:
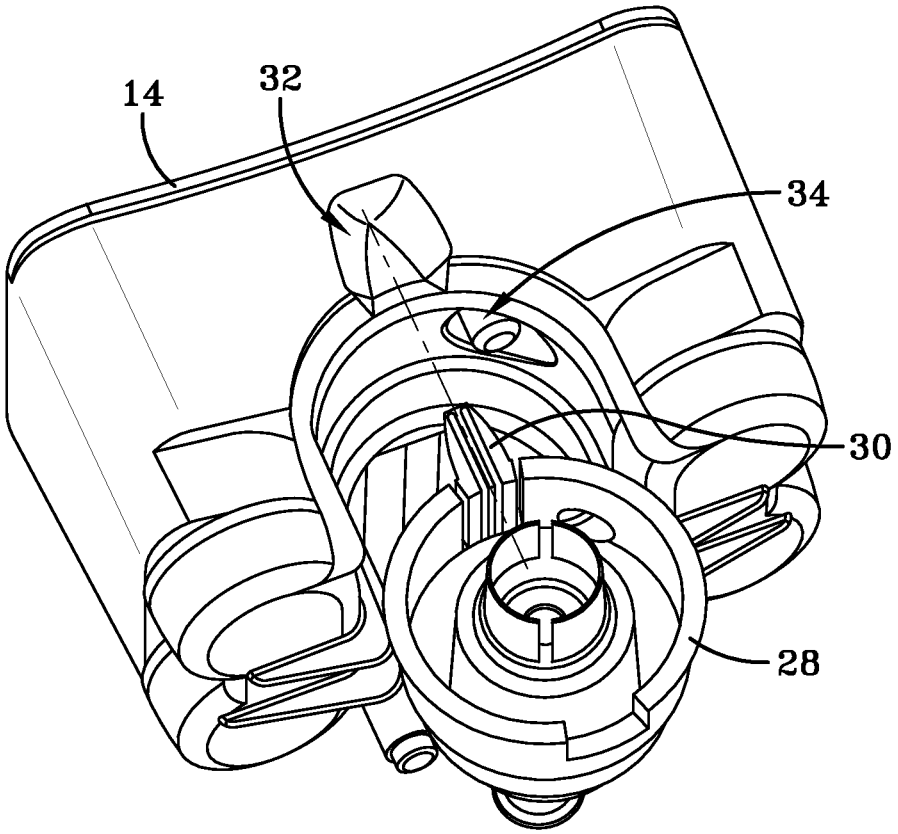
FIG. 2 is an exploded perspective view of a portion of the keyed fluid dispenser.
Figure 3:
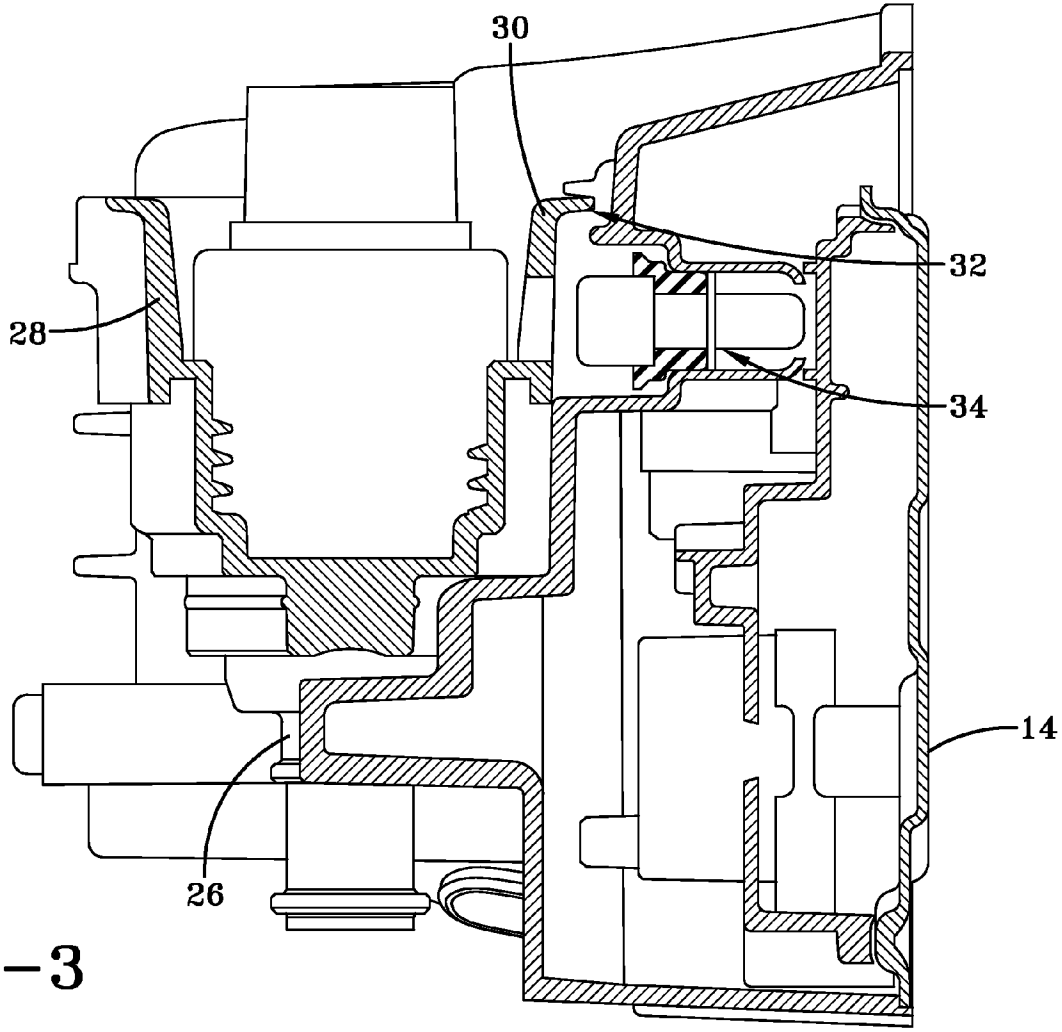
FIG. 3 is a side cross-section view of the portion of the keyed fluid dispenser shown in FIG. 2.
Figure 4:
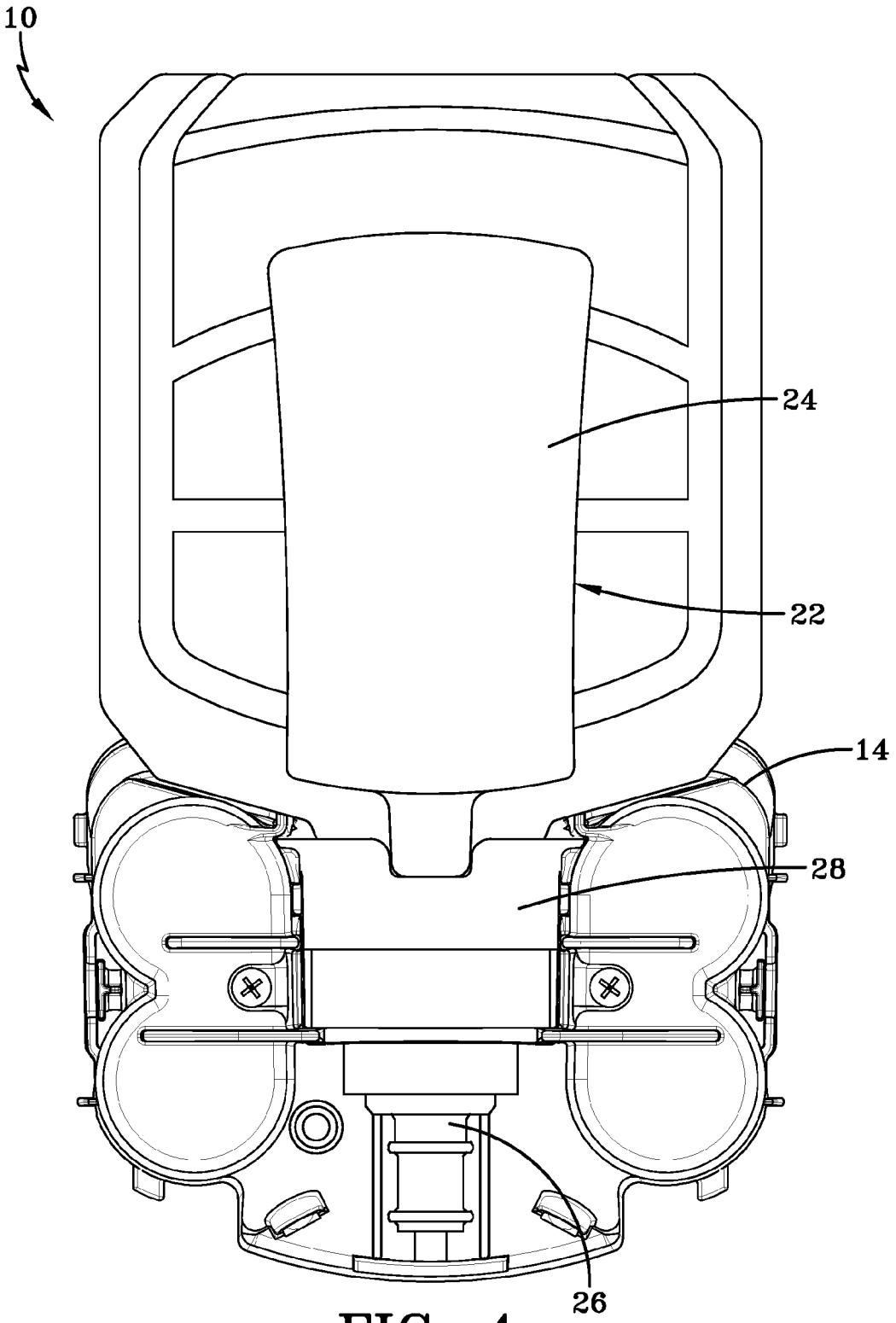
FIG. 4 is a front elevational view of the refill unit of the keyed fluid dispenser when received within the dispenser.

Refill unit 22 further includes a collar 28 that may be positioned around pump mechanism 26. Collar 28 is adapted to be received in housing 12 to secure the refill unit therein. In the embodiment shown in the figures, collar 28 is generally cylindrical in shape. However, collar 28 may be provided in any form that is adapted to be received within housing 12. Collar 28 may optionally include a mechanical key 30 projecting therefrom (FIG. 2). Key 30 is adapted to be received in a keyway 32 in housing 12, with the keyway 32 having a shape corresponding to key 30. Key 30 and keyway 32 further help to prevent the insertion of an incorrect refill unit into housing 12. Key 30 and keyway 32 may have any desired shape or arrangement so long as keyway 32 is adapted to receive key 30 therein.

In certain embodiments, collar 28 may be formed from any known thermoplastic polymer resin. For example, collar 28 may be formed from a polyester resin. More specifically, collar 28 may be formed from polyethylene terephthalate (PET), which is a thermoplastic polymer resin of the polyester family. The thermoplastic resin may also include any known fillers to improve or enhance the characteristics of the resulting collar 28. According to the concepts of the present invention, collar 28 is formed from a thermoplastic resin including an identifying agent, also referred to herein as a taggant, as will be discussed in more detail below.

The taggant may be mixed with the thermoplastic resin during the manufacturing process of collar 28, thereby producing a collar having a taggant dispersed therein. The taggant identifies the collar, and the refill unit 22 associated therewith, as an appropriate and authorized refill for the dispenser. The taggant dispersed in collar 28 is adapted to be detected by an infrared (IR) sensor 34 provided in housing 12. Thus, when the taggant dispersed within collar 28 is subjected to infrared radiation it emits detectable wavelengths of energy.

The taggant may be any known chemical, compound or material capable of emitting a detectable signal when exposed to infrared radiation. One example of a taggant material that may be dispersed within the collar 28 is a base material of lattice structure that includes one or more rare-earth metal dopants. By varying the level of dopant, or the position of the dopant molecules within the lattice, it is possible to produce a range of taggant materials that exhibit different, but predictable and repeatable emission characteristics when excited by a radiation source. Other suitable taggant materials are well known to those skilled in the art, and any commercially available taggant may be used in conjunction with the present invention. To facilitate dispersion of the taggant throughout the thermoplastic resin, the taggant may be considered a micro-particle and may range in size from 20 to 600 microns.

Infrared sensor 34 includes an infrared radiation signal generator as well as a signal detector for detecting the energy emitted by the taggant within collar 28. These IR sensors are well known in the art, and any combination of known signal generators and detectors may be employed. It is also contemplated that an IR signal generator and a detector for detecting the energy emitted by the taggant may be provided separately. In either case, the infrared sensor 34 will require an energy source. The energy source may be a battery provided within the housing 12 or an external power source. If the dispensing system 10 is a hands free system relying upon battery power, the infrared sensor 34 may rely upon the same batteries or power supply as the dispensing mechanism of the system. In one or more embodiments, infrared sensor 34 is mounted at a location on or in housing 12 so as to be positioned above what may be referred to as the "splash zone," or area likely to be sprayed by the liquid or foam dispensed, as will be understood by those skilled in the art.

The controller (not shown) within the housing 12 controls the ability of dispensing system 10 to dispense fluid from a refill unit 22 based upon the signal, or lack thereof, identified by infrared sensor 34. When a refill unit 22 is installed within housing 12 and includes a taggant in the collar 28 that is detectable by the infrared sensor 34, then the controller allows the dispensing mechanism to function. Conversely, if a refill unit is installed within housing 12 that does not include a taggant within the collar that is detectable by the infrared sensor 34, then the controller will prevent actuation of the dispenser. In this way, the manufacturer of the dispensing system 10 maintains control over the quality and type of product dispensed therefrom. It is also contemplated that different densities of taggant may be provided in different refill units to distinguish between various products and customers. The varying of the density of taggant is believed to result in varying signals or strength of energy emitted from the taggant when subjected to IR radiation. Alternatively, it is contemplated that UV absorbers may be included with the taggant in the refill unit to alter the wavelength of the signal emitted by the taggant, thereby providing a unique electronic key to the refill unit.

In certain embodiments of the invention collar 28 may include a flag or other projection extending therefrom. Rather than providing a taggant throughout the entire collar 28, the taggant may be provided only in the flag. Accordingly, the flag would be positioned adjacent to an infrared sensor 34 within housing 12 so that the sensor could easily detect the energy emitted by the taggant when subjected to infrared radiation. A space or gap may be provided between the flag and the infrared sensor to improve the detection and reliability of the sensor. In certain embodiments, the taggant may be provided in key 30, with the key and sensor 34 arranged in close proximity.

In certain embodiments, a mechanical keying system may also be provided to enhance the security of the dispensing system. Mechanical keying systems are well known in the art, and typically include a physical key located on the refill unit, and a receiving keyway located on the housing. The existence of an incorrect mechanical key may prevent insertion of the refill unit into the housing, thereby preventing stuffing. In one or more embodiments, an electronic keying system may be provided to identify the manufacturer of the refill unit, and a mechanical key may be used to distinguish between several refill units produced by the same manufacturer. Thus, only a refill unit including the taggant and the correct mechanical key will allow the refill unit to be inserted into the housing, and the dispenser to dispense product. An exemplary mechanical keying system is disclosed in U.S. Pat. No. 7,798,370, which is incorporated herein for the purpose of teaching a suitable mechanical keying system.

Figure 5:
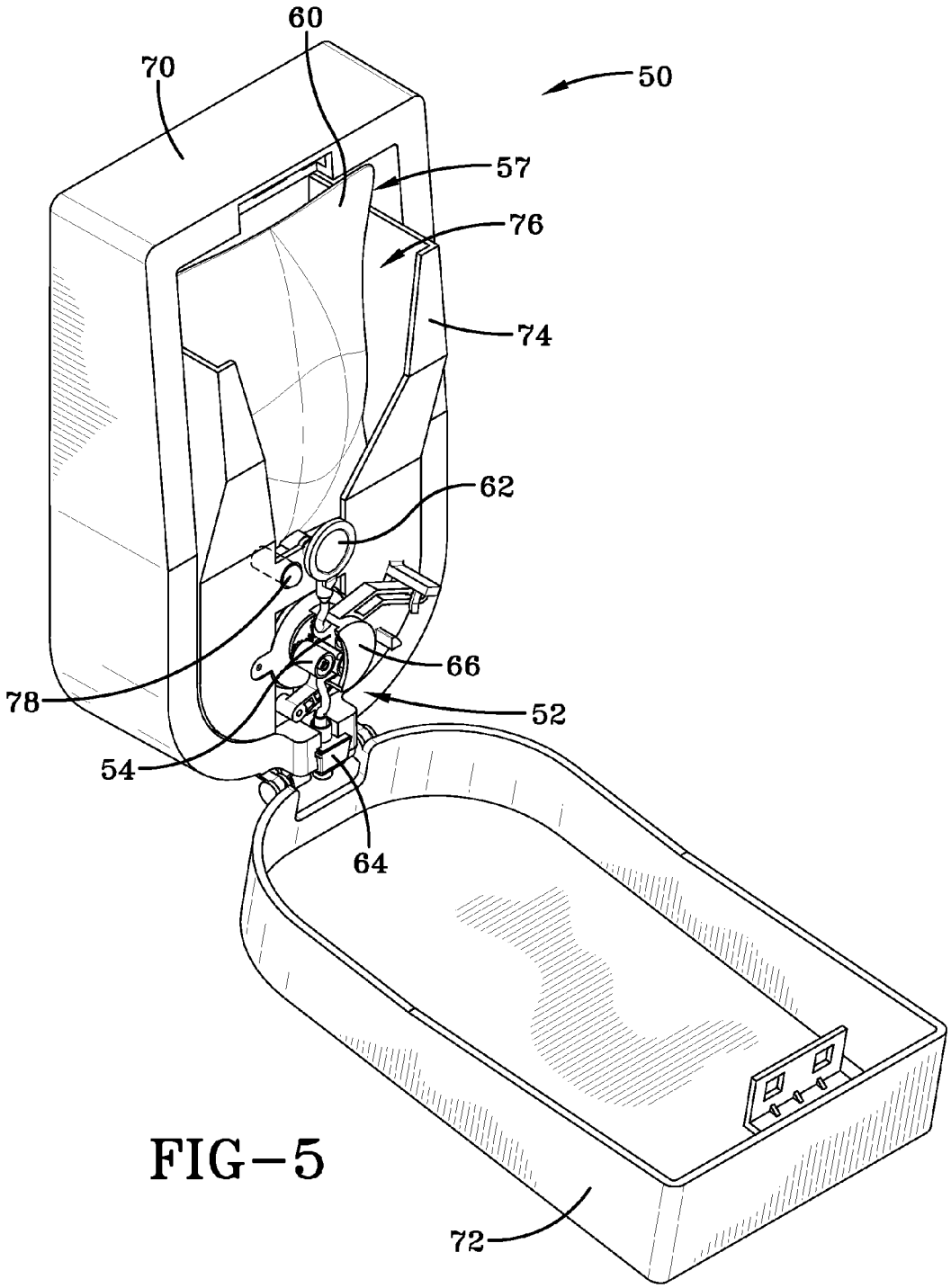
FIG. 5 is a perspective view of an alternative embodiment of the keyed fluid dispenser in accordance with the concepts of the present invention.
Figure 6:
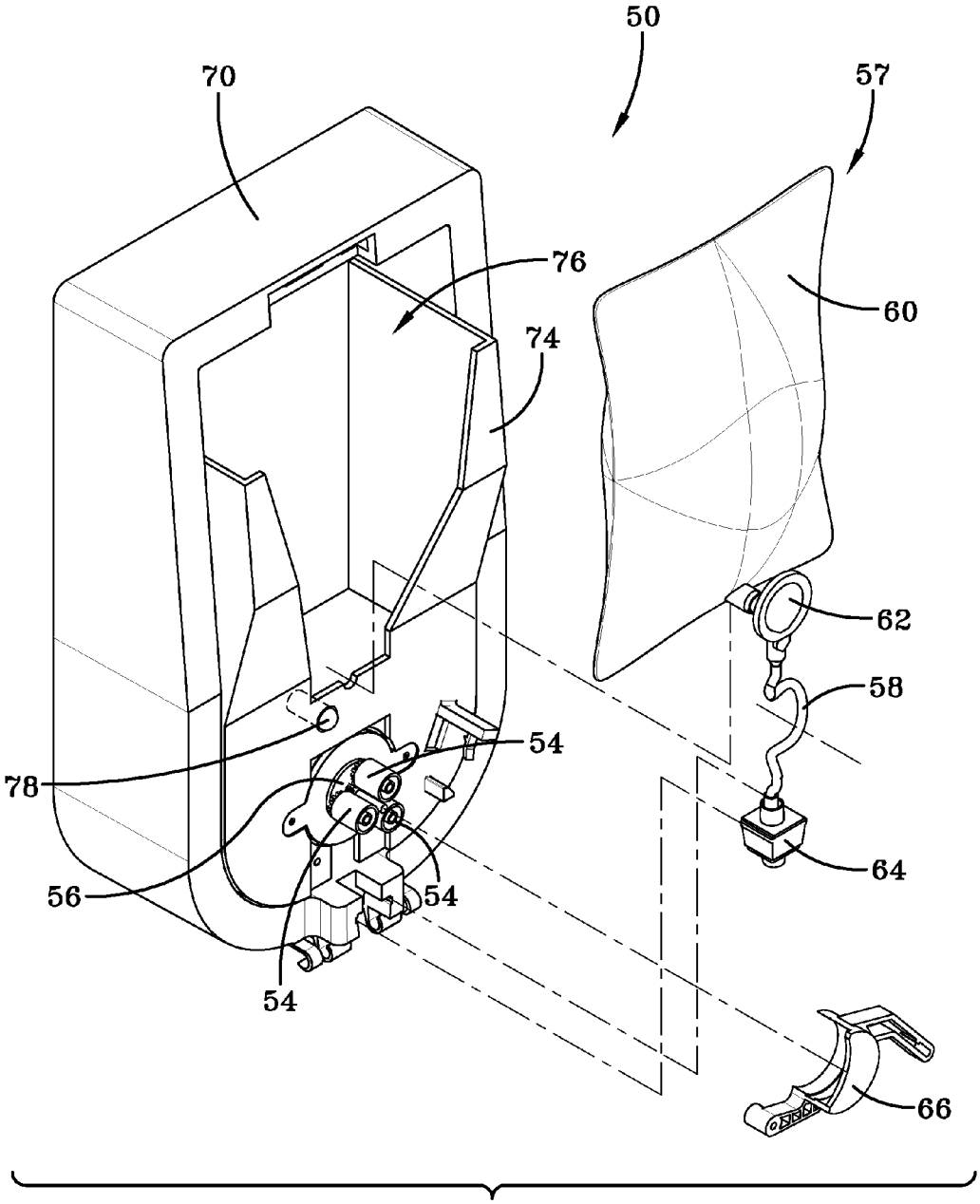
FIG. 6 is an exploded view of the alternative embodiment of the keyed fluid dispenser of FIG. 5.

Referring now to FIGS. 5 and 6, an alternative embodiment of a keyed fluid dispenser is shown, and is indicated generally by the numeral 50. The foaming dispenser 10 comprises a peristaltic pump 52 that includes a plurality of rotating engagement members 54 that are carried by a rotating drive plate 56 that is driven by a motor drive operatively coupled thereto. A refill unit 57 includes a flexible outlet tube 58 that is fluidly coupled at one end to a refill container 60 via an attachment adapter 62. In certain embodiments, the other end of the outlet tube 58 may be coupled to a foaming chip nozzle 64. The outlet tube 58 is compressively retained against the rotating engagement members 54 by a guide 66 that is pivotably and removably attached to the dispenser 10. Thus, as the engagement members 54 rotate and compress the outlet tube 58 against the guide 66, liquid material, such as soap, carried by the refill container 60 is drawn or otherwise pumped into the outlet tube 58 and forced under pressure into the foaming chip nozzle 64, where air is introduced into the pressurized liquid material, aerating it into a foam that is dispensed therefrom.

The dispenser 10 includes a housing 70 and a pivoting door 72 attached thereto that can be moved between open and closed positions. A frame section 74 is disposed within the housing 70, which provides a retention bin 76 to house and support the refill container 60 placed therein. In certain embodiments, housing 70 may include an infrared sensor 78, as discussed above, that is adapted to detect the presence of energy emitted by a taggant dispersed within a molded portion of the refill unit 57. In one or more embodiments, the taggant may be dispersed within the attachment adaptor 62. However, it is contemplated that the taggant may be provided in any portion of the refill unit that is made of a thermoplastic polymer resin, and the infrared sensor 78 positioned at a location on housing 70 adjacent to the location of the taggant containing portion of the refill unit.

Figure 7:
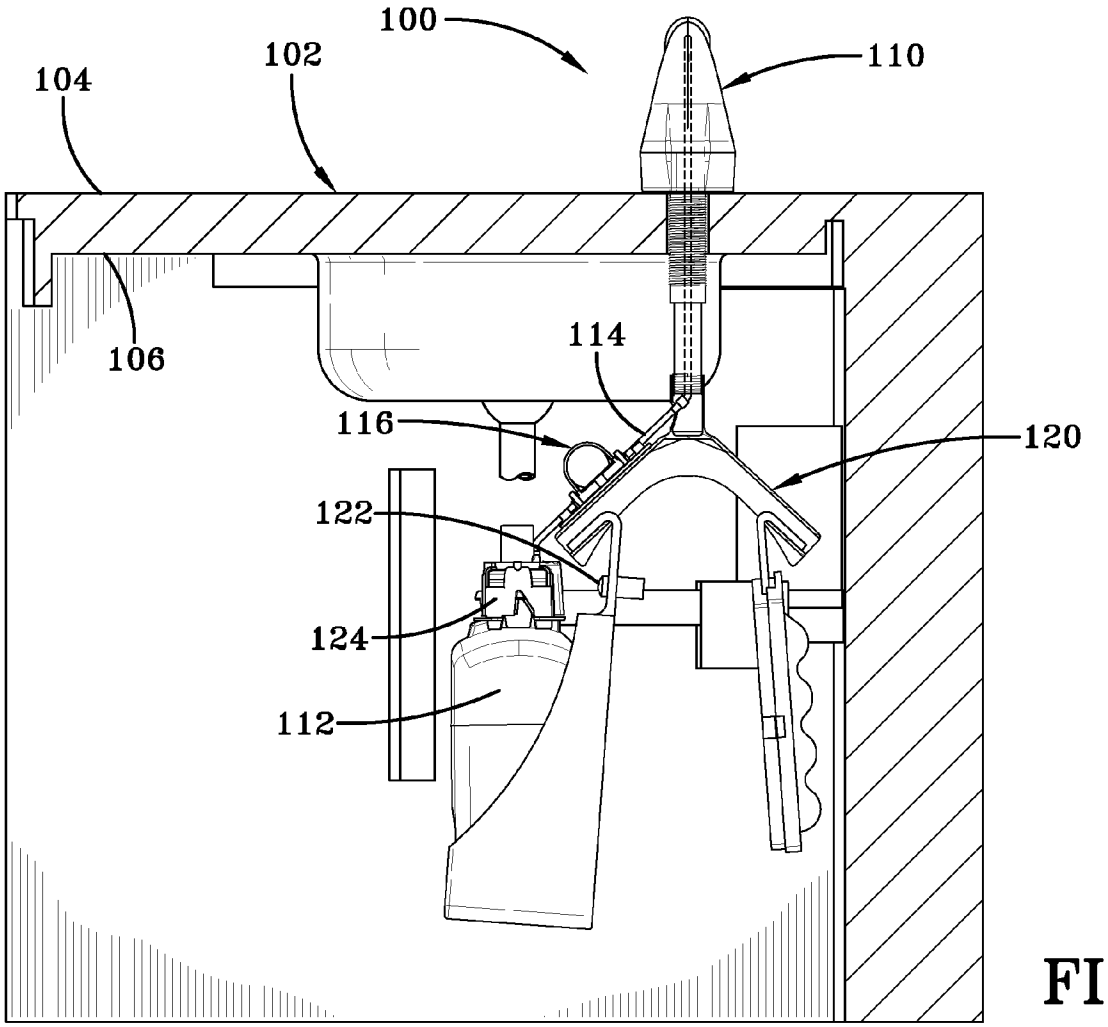
FIG. 7 is a rear elevational view of another alternative embodiment of a keyed fluid dispenser according to the concepts of the present invention, the dispenser being configured to be mounted underneath a mounting base.
Figure 8:
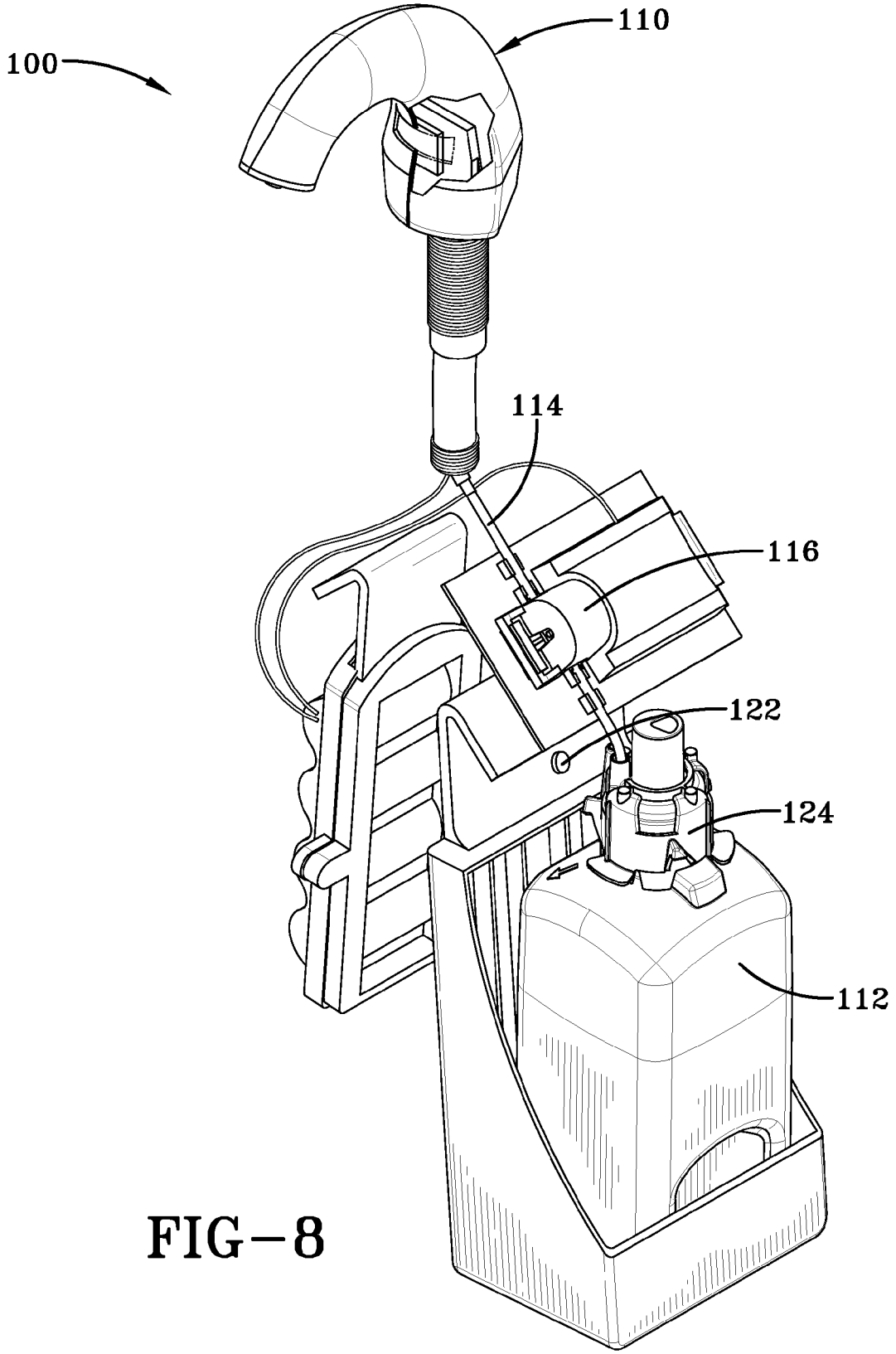
FIG. 8 is a perspective view of the keyed fluid dispenser of FIG. 7.

Referring now to FIGS. 7 and 8, another alternative embodiment of a keyed fluid dispenser is shown and is indicated generally by the numeral 100. Dispenser 100 is configured to be mounted to a mounting base 102, as shown in FIG. 7. For example, the mounting base 102 may comprise a countertop surface, such as that used to support a lavatory sink used to wash one's hands in a restroom. The mounting base 102 includes an upper surface 104 and opposed lower surface 106 and may comprise any structure suitable for mounting the dispenser 100 formed from any suitable material, such as wood, plastic, or ceramic for example.

The dispenser 100 includes a nozzle 110 that is in fluid communication with a refill container 112 via an outlet tube 114. Liquid material, such as liquid soap, sanitizer, moisturizer, or the like that is carried by the refill container 112 is pumped therefrom via the outlet tube 114 by a pump 116 that is in operative communication with the outlet tube 114. In the embodiment depicted, pump 116 is a peristaltic pump, but dispenser 100 may be adapted to utilize any known pump design. As the liquid material passes through the outlet tube 114, it may be converted from liquid to foam by a foaming chip retained within the nozzle 110, which is in fluid communication with the outlet tube 114. In addition, the peristaltic pump 116, the refill container 112 and various other components of the dispenser 100 are suspended off of the floor underneath the mounting base 102 by a support hanger 120. As such, the components of the dispenser 100 are able to be concealed underneath the mounting base 102 and hidden from the view of the user, without taking up floor space beneath the mounting base.

In certain embodiments, dispenser 100 may include an infrared sensor 122, as discussed above with respect to the other embodiments, that is adapted to detect the presence of energy emitted by a taggant dispersed within a molded portion of the refill container 112. In one or more embodiments, the taggant may be dispersed within a collar 124 of the refill container 112. However, it is contemplated that the taggant may be provided in any portion of the refill container that is made of a thermoplastic polymer resin, and the infrared sensor 122 may be positioned at a location adjacent to the location of the taggant containing portion of the refill unit. In certain embodiments, the infrared sensor 122 may be secured to the support hanger 120 of dispenser 100. Infrared sensor 122 and pump 116 may be connected to a common power source and control circuit, or, optionally, may be connected to separate power supplies and control circuits. Operation of pump 116 is prevented unless the presence of a taggant within refill container 112 is detected by infrared sensor 122.

It is thus evident that a dispensing system constructed as described herein accomplishes the objects of the present invention and otherwise substantially improves the art. In accordance with the Patent Statutes, only the best mode and preferred embodiment have been presented and described in detail, and the invention should not be limited by that description. For an appreciation of the true scope and breadth of the invention, reference should be made to the following claims.

The invention claimed is:

1. A product dispenser unit for receipt of a refill unit having a reservoir of a product, the dispenser unit comprising:

a housing configured to accept the refill unit;

an infrared sensor provided by said housing;

an actuator configured to actuate a pump to dispense at least a portion of the product in the refill unit wherein the refill unit is made from polymeric material and has a taggant dispersed uniformly throughout the material of the refill unit which when subjected to infrared radiation generated by said infrared sensor causes the taggant to emit predictable and repeatable emission characteristics so that the dispenser unit can identify the refill unit as an appropriate and authorized refill unit, where different densities of taggant are provided in different refill units to vary the strength of infrared energy emitted from the taggant; and said infrared sensor configured to distinguish between infrared radiation emitted from different refill units and to control actuation of said pump in response thereto.

2. The product dispenser of claim 1, wherein said actuator includes an automated sensor and wherein said infrared sensor and said automated sensor are connected to a common power source and controller.

3. A dispensing system comprising:

a housing including an actuator and an infrared sensor, said infrared sensor including an infrared radiation source and a detector; and a refill unit including a product reservoir containing a product, wherein a taggant is dispersed within at least a portion of said refill unit, and wherein different densities of taggant are provided in different refill units to vary the strength of infrared energy emitted from the taggant, said taggant being detectable by the infrared sensor to identify an authorized refill unit and prevent actuation of said actuator if an unauthorized refill unit is installed.

4. The dispensing system of claim 3, further comprising a controller in communication with said actuator and said infrared sensor, said controller adapted to prevent actuation of said actuator in the absence of a taggant detected by the infrared sensor.

5. The dispensing system of claim 3, wherein said taggant is dispersed within a plastic component of said refill unit.

6. The dispensing system of claim 3, wherein said refill unit includes a collar, and said taggant is dispersed within said collar.

7. The dispensing system of claim 3, wherein said taggant includes particles of a rare earth metal dopant that have a maximum diameter of between 20 and 600 microns.

8. The dispensing system of claim 3, wherein said refill unit includes a flag extending therefrom, said flag containing said taggant therein.

9. The dispensing system of claim 3, wherein said refill unit includes a mechanical key and said housing includes a keyway, said key being received in said keyway when said refill unit is received in said housing.

10. A method of preventing use of unauthorized refill units in a dispensing system comprising:

providing a dispenser housing including an actuator and an infrared sensor having an infrared radiation source and a detector; and providing a refill unit having a reservoir of product, where at least a portion of the refill unit is molded from thermoplastic material;

providing a taggant mixed with the thermoplastic material and dispersed within said refill unit in predetermined quantities varied to distinguish between various products and customers of the product in said reservoir;

generating an infrared radiation signal by said infrared radiation source;

emitting detectable wavelengths of energy by said taggant, wherein said taggant is detectable by said infrared radiation detector, and determining if said detectable wavelengths are within a strength of energy emitted to allow said actuator to function wherein absence of said taggant prevents dispensing of said product by said actuator.

11. The method of claim 10, further comprising:

dispensing a quantity of said product upon detection of said taggant.

12. The method of claim 11, wherein dispensing includes pumping a quantity of liquid from said reservoir.

* * * * *